US005493801A

United States Patent [19]

James

[11] Patent Number: 5,493,801

[45] Date of Patent: Feb. 27, 1996

[54] DISPLAY DEVICE HAVING ALTERABLE PRODUCT INDICIA

[76] Inventor: Lance James, 233 Clifton Blvd., Clifton, N.J. 07011

[21] Appl. No.: 137,492

[22] Filed: Oct. 14, 1993

[51] Int. Cl.[6] ..... G09F 3/10

[52] U.S. Cl. ..... 40/299; 206/459.1; 206/45.14

[58] Field of Search ..... 40/299, 657, 664; 283/103, 105, 106, 61, 62, 81; 206/45.14, 459.1, 806; 211/54.1, 57.1, 59.1

[56] References Cited

U.S. PATENT DOCUMENTS

| | | | |
|---|---|---|---|
| 2,198,138 | 4/1940 | Sutton | 206/482 |
| 2,246,365 | 6/1941 | Kohnle | 40/299 |
| 4,669,611 | 6/1987 | Flaherty | 206/459.5 X |
| 4,780,974 | 11/1988 | Mitchell | 40/299 |
| 5,052,718 | 10/1991 | Gold | 283/106 X |
| 5,201,413 | 4/1993 | De Blasio et al. | 206/459.1 X |
| 5,390,794 | 2/1995 | Vulpitta | 206/45.14 X |

*Primary Examiner*—Brian K. Green
*Attorney, Agent, or Firm*—Michael, Best & Friedrich

[57] ABSTRACT

A device for use in displaying product, the device including a first section including a surface selectively affixable to a first unit of product, and a second section including a surface selectively affixable to a second unit of product, the second section being selectively removable from the first section, the device being selectively alterable from a first mode wherein the device displays indicia relevant to multiple units of product to a second mode wherein the device displays indicia relevant to individual units of product.

7 Claims, 2 Drawing Sheets

10
12
14
28
30
32
34
36
38
40
64
66
68
70

DISPLAY DEVICE HAVING ALTERABLE PRODUCT INDICIA

FIELD OF THE INVENTION

The invention relates to apparatus on products for use in displaying the products, such as in connection with a display rack, and having thereon information relating to the products.

BACKGROUND OF THE INVENTION

It is known to affix to a product a card which has therethrough an aperture for passing a hook from a display rack. The card is thus employed for supporting a product from a display rack such as a display rack utilized in a retail store. Such cards are employed with a multitude of products. A substantial number of the products that are retailed from display racks utilize such cards.

Such a card provides rigidity so that the hook does not expand the aperture, under the weight of the product, through to an edge such that the product falls from the display. For example, it is common to affix such a card to an otherwise easily tearable cellophane bag containing a product, or to employ such a card to support heavy items such as batteries from a display rack.

Such a card can also be employed to provide a surface on which information concerning the product can be placed. This information can include, for example, the name of the product, weight or quantity of product, or price information.

It is also known to sell products in quantities at per unit prices that are lower than if a single unit of a product is purchased.

SUMMARY OF THE INVENTION

The invention provides a device which supports multiple units of products, and provides for selective display of the products as either a multi-pack, or as individual units.

One aspect of the invention provides a device for use in displaying product, the device comprising a first section including a surface selectively affixable to a first unit of product; and a second section attached to the first section and including a surface selectively affixable to a second unit of product, the second section being selectively removable from the first section; the device being selectively alterable from a first mode wherein the device displays indicia relevant to multiple units of product to a second mode wherein the device displays indicia relevant to individual units of product.

Another aspect of the invention provides a display device comprising a first section including a surface selectively supporting a first unit of product; a second section attached to the first section and including a surface selectively supporting a second unit of product, the second section being selectively removable from the first section; concealed, selectively revealable indicia on the first section; concealed, selectively revealable indicia on the second section; and visible, selectively removable indicia supported by at least one of the first and second sections.

Another aspect of the invention provides a display assembly comprising a first unit of product; a second unit of product; and a display card including a first portion comprising a first section supporting the first unit of product, and comprising a second section supporting the second unit of product; a perforation between the first section and the second section, the second section being selectively removable from the first section by tearing along the perforation; a barcode on the first section; a barcode on the second section; a second portion connected to the first portion and covering the barcode on the first section and the barcode on the second section; and a perforation between the first portion and the second portion, the second portion being separable from the first portion by tearing along the perforation between the first portion and the second portion.

Other features and advantages of the invention will become apparent to those of ordinary skill in the art upon review of the following detailed description, claims, and drawings.

Figures 1, 2:
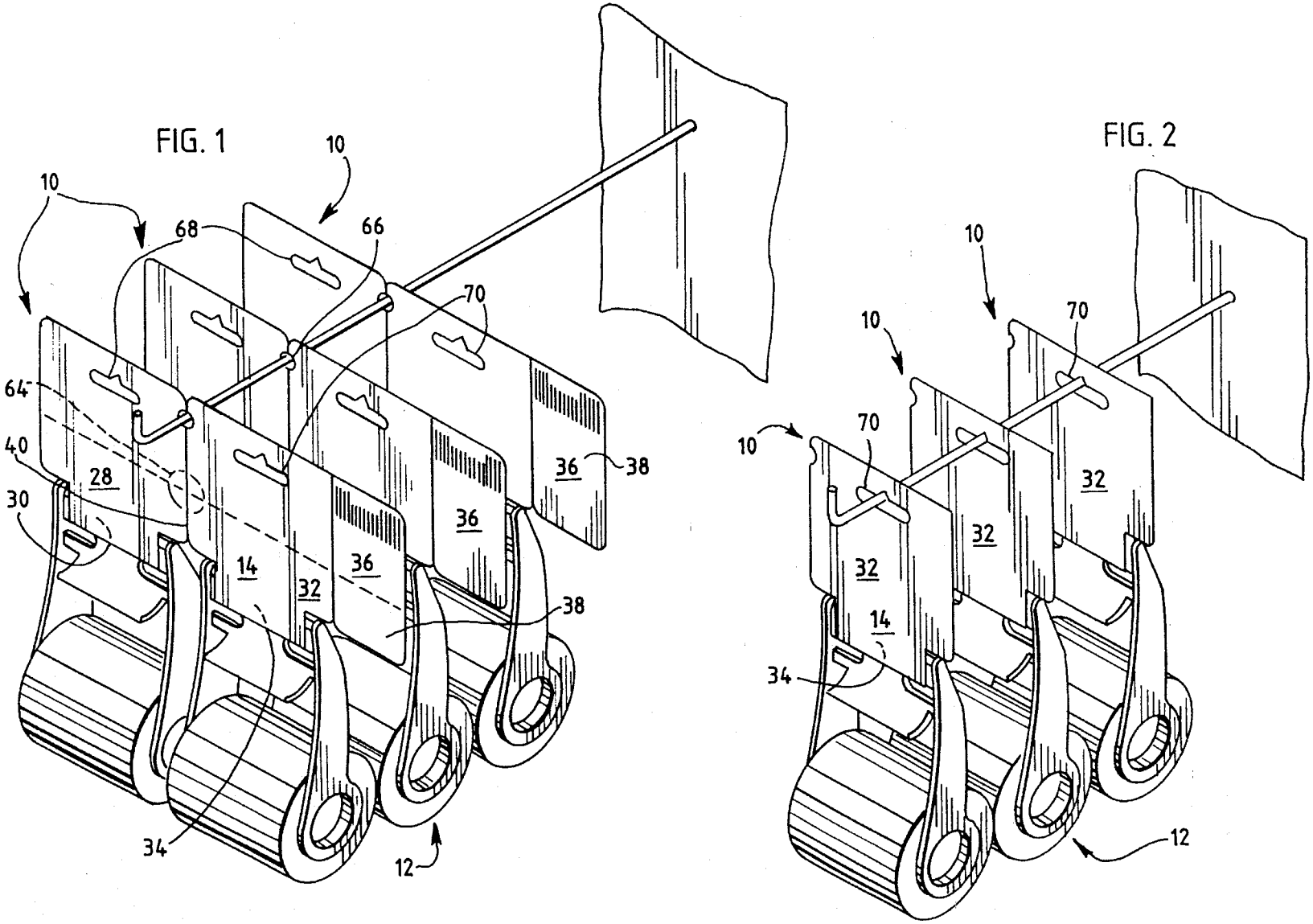
FIG. 1 is a perspective view showing the display card device of the invention supporting products as a multi-pack, the display device being supported from a display rack.
FIG. 2 is a perspective view showing the display card device of FIG. 1 altered to a mode wherein product units are sold individually.

Before one embodiment of the invention is explained in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

DETAILED DESCRIPTION OF THE PREFERRED EMBODIMENT OF THE INVENTION

Shown in the various figures is a display card device 10 for use in the display of products. The device 10 supports and connects multiple units of products 12, and provides for selective display of the products 12 as either a multi-pack (see FIG. 1), or as individual units (see FIG. 2).

The device 10 is selectively alterable from a first mode wherein indicia is displayed relevant to multiple units of product to a second mode wherein indicia is displayed relevant to individual units of product. For example, when the products 12 are sold as a two-pack, the device 10 is in a first mode wherein indicia, such as price or other product information for the two-pack is displayed. When the products 12 are sold individually, the device 10 can be altered to a second mode wherein indicia relevant to individual products can be displayed.

This feature is useful because when the products 12 are sold as a two-pack, as opposed to when sold individually, per unit price may be reduced, and it may be desirable to indicate information such as price, weight, size, product name etc. for the two units of product together. Also, bar codes, if used, will be different when the products 12 are sold as a two-pack, as opposed to when sold individually. Thus, the indicia displayed when the device 10 is in the first mode may be different than when the device 10 is in the second mode.

The device 10 includes a generally rectangular product support portion 14 having front and back sides 16 and 18, respectively, a pair of opposite long edges 20 and 22 (see FIG. 4), and a pair of opposite short edges 24 and 26. A length dimension is defined as the perpendicular distance between the short edges 24 and 26, and a width dimension is defined as the perpendicular distance between the long edges 20 and 22. The length of the product support portion 14 is divided to include a first section 28 including a surface 30 at or adjacent the edge 20, a second section 32 adjacent the first section 28 and including a surface 34 at or adjacent the edge 20, and a third section 36 adjacent to the second section 32 and having thereon indicia 38 relevant to multiple units of product 12. The surface 30 is selectively affixable to the first unit of product 12 to support the first unit of product 12, and the surface 34 is selectively affixable to a second unit of product 12 to support the second unit of product 12.

Figure 3:
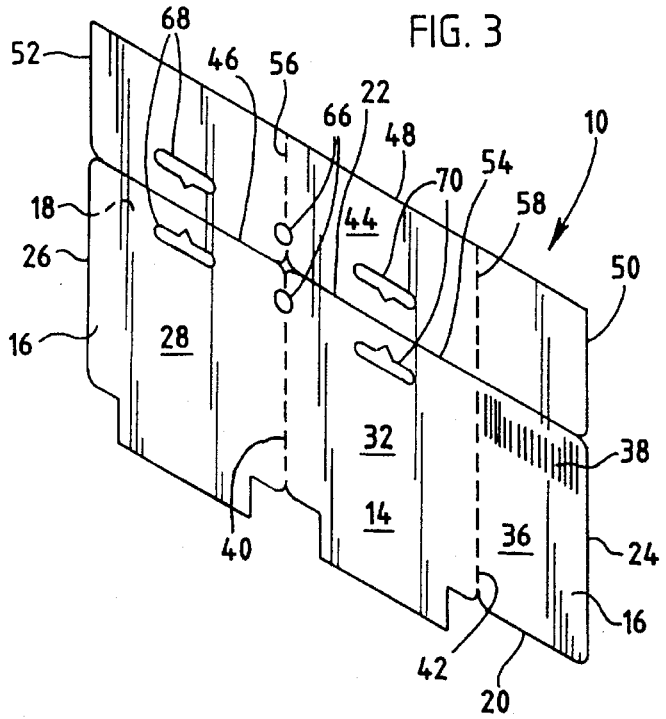
FIG. 3 is a pre-assembly perspective view of the display card device of FIG. 1 and showing the front of a product support portion thereof.

In the illustrated embodiment, the third section 36 has printed thereon, on the front 16 thereof, a barcode 38 including information relevant to two units of product 12 (see FIG. 3). The barcode 38 is of the type commonly found on retailed products, including price and product information, and capable of being scanned by a checkout scanner. In the illustrated embodiment, a unit of product 12 is affixed to the surface 30, and a unit of product 12 is affixed to the surface 34.

The product support portion 14 includes a perforation 40 between the first section 28 and the second section 32, and extending from the edge 20 to the edge 22. The perforation 40 provides for selective separation of the second section 32 from the first section 28. The product support portion 14 also includes a perforation 42 between the second section 32 and the third section 36, and extending from the edge 20 to the edge 22. The perforation 42 provides for selective separation of the third section 36 from the second section 32.

The device 10 further includes a generally rectangular flap portion 44 having a pair of opposite long edges 46 and 48, and a pair of opposite short edges 50 and 52. The length of the flap portion 44 (the perpendicular distance between the short edges 50 and 52 of the flap portion 44) is the same as the length of the product support portion 14 (the perpendicular distance between the short edges 24 and 26 of the product support portion 14). The width of the flap portion 44 (the perpendicular distance between the long edges 46 and 48 of the flap portion 44) is less than the width of the product support portion 14 (the perpendicular distance between the long edges 20 and 22 of the product support portion 14).

Figure 4:
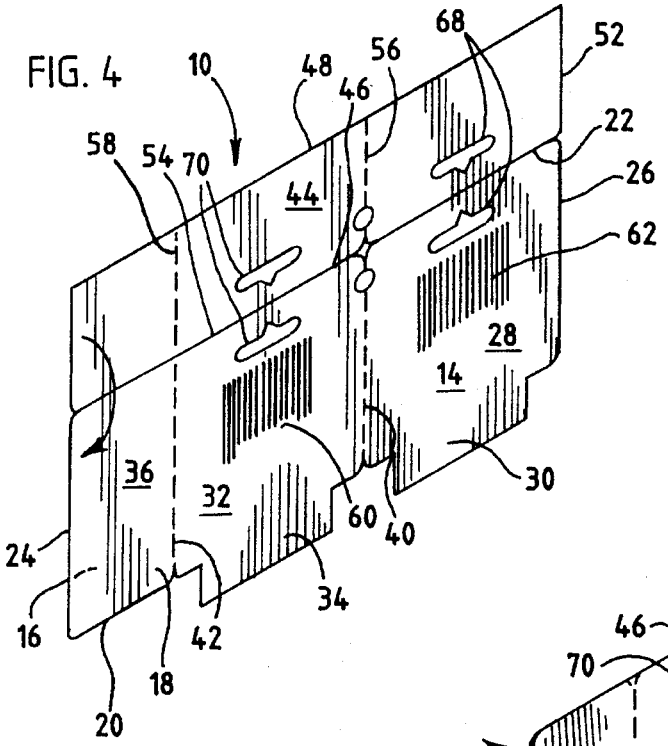
FIG. 4 is a pre-assembly perspective view of the display card device of FIG. 1 and showing the rear of a product support portion thereof.

The long edge 46 of the flap portion 44 is hingedly attached to the long edge 22 of the product support portion 14 along a perforation 54 (see FIG. 4). The flap portion 44, in the first mode of the device 10, lies against the back 18 of the product support portion 14 with the edge 50 of the flap portion 44 aligned with the edge 24 of the product support portion 14, with the edge 52 of the flap portion 44 aligned with the edge 26 of the product support portion 14, and such that the flap portion 44 partially covers each of the first, second and third sections 28, 32, and 36, of the product support portion 14 (see FIG. 5).

Figure 5:
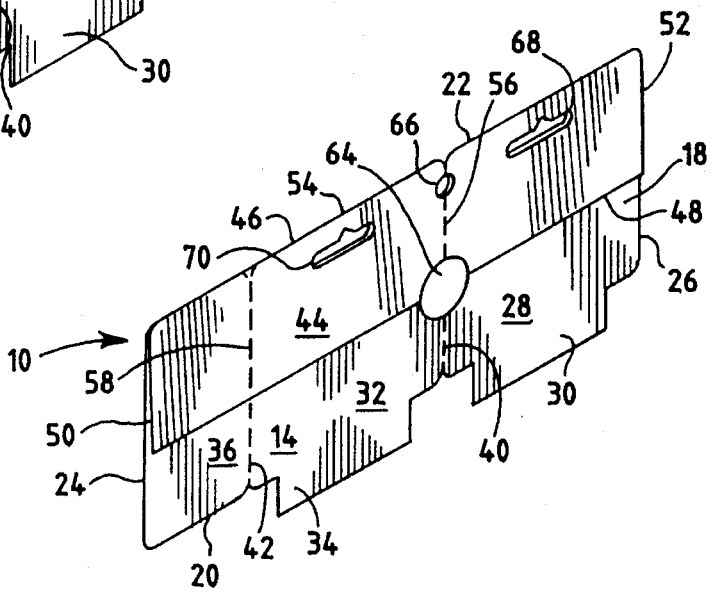
FIG. 5 is a post-assembly perspective view of the display card device of FIG. 1 and showing the rear of a product support portion thereof.

The flap portion 44 optionally includes a perforation 56, which, when the device 10 is in its first mode, is aligned with the perforation 40 (see FIG. 5). The flap portion 44 also optionally includes a perforation 58, which, when the device 10 is in its first mode, is aligned with the perforation 42 (see FIG. 5).

The device 10 further includes, on the second section 32 and concealed by the flap portion 44 when the device 10 is in the first mode, indicia 60 relevant to the single unit of product 12 that the second section 32 supports (see FIG. 4). More particularly, in the illustrated embodiment, the second section 32 has printed thereon, on the back 18 thereof, a barcode including information relevant to the unit of product 12 that the second section 32 supports.. The barcode 60 is of the type commonly found on retailed products, including price and product information, and capable of being scanned by a checkout scanner. The device 10 further includes, on the first section 28 and concealed by the flap portion 44 when the device 10 is in the first mode, indicia 62 relevant to the single unit of product 12 that the first section 28 supports (see FIG. 4). More particularly, in the illustrated embodiment, the first section 28 has printed thereon, on the back 18 thereof, a barcode including information relevant to the unit of product 12 that the first section 28 supports. The barcode 62 is of the type commonly found on retailed products, including price and product information, and capable of being scanned by a checkout scanner.

The device 10 further includes means for releasably securing the flap portion 44 against the product support portion 14. While other means could be employed, in the illustrated embodiment this means comprises a piece of tape 64 (see FIG. 5).

The device 10 further includes means, located approximately along a vertical line passing through the center of gravity of the two-pack (including the device 10 and the two units of product 12), for selective supportive engagement by a display rack. In the illustrated embodiment, this means comprises apertures 66, proximate but spaced from the perforation 54, through the flap portion 44 and the product support portion 14 and through the perforation 40, which apertures 66 are aligned when the device 10 is in its first mode with the flap portion 44 lying against the back 18 of the product support portion 14 (see FIG. 5). The aligned apertures 66 are of sufficient size to pass a hook from a display rack.

The device 10 further includes means, located approximately halfway between the perforation 40 and the edge 26, for selective supportive engagement by a display rack when the first section 28 is separated from the second section 32 and the unit of product 12 supported by the second section 32 is sold separately from the unit of product 12 supported by the first section 28. In the illustrated embodiment, this means comprises aligned apertures 68, proximate but spaced from the perforation 54, through the flap portion 44 and the first section 28, which apertures 68 are aligned when the device 10 is in its first mode with the flap portion 44 lying against the back 18 of the product support portion 14. The aligned apertures 68 are of sufficient size to pass a hook from a display rack so that the display rack can support the first section 28 and the unit of product 12 supported therefrom.

The device 10 further includes means, located approximately halfway between the perforation 40 and the perforation 42, for selective supportive engagement by a display rack when the first section 28 is separated from the second section 32 and the unit of product 12 supported by the first section 28 is sold separately from the unit of product 12 supported by the second section 32. In the illustrated embodiment, this means comprises aligned apertures 70, proximate but spaced from the perforation 54, through the flap portion 44 and the second section 32, which apertures 68 are aligned when the device 10 is in its first mode with the flap portion 44 lying against the back 18 of the product support portion 14. The aligned apertures 68 are of sufficient size to pass a hook from a display rack so that the display rack can support the second section 32 and the unit of product 12 supported therefrom.

If it is desired to display the product units 12 individually, instead of as a two-pack, the device 10 is altered from the first mode to the second mode by tearing the tape 64 or separating the tape 64 from the product support portion 14, and by tearing away the flap portion 44 and the third section 36 to expose indicia 60 on the second section 32 and indicia 62 on the first section 28. The second section 32 can then be separated from the first section 28.

Many other means can be employed in accordance with the invention to provide for selective alteration from a first mode, wherein indicia is displayed relevant to multiple units of product, to the second mode wherein indicia is displayed relevant to individual units of product. In one embodiment of the invention (not shown), the third section 36 is eliminated and the indicia relevant to the multi-pack is located on the removable flap portion 44. In another embodiment of the invention, instead of employing a removable flap, the indicia on the first section 28 and the indicia on the second section 32 are covered with peelable tape. In another embodiment of the invention, the indicia on the first section 28 and the indicia on the second section 32 are printed using ultraviolet sensitive ink which is not visible until activated by exposure to UV light. In yet another embodiment of the invention, a scratch and remove surface, such as those used on lottery and game cards, is used to cover the indicia on the first section 28 and the indicia on the second section 32. In yet another embodiment of the invention, a clear window is provided in each of the first and second sections 28 and 32, which windows slidingly receive replaceable indicia carrying inserts. The scope of protection sought covers these and all other means to provide for selective alteration from a first mode, wherein indicia is displayed relevant to multiple units of product, to the second mode wherein indicia is displayed relevant to individual units of product.

While an embodiment has been disclosed which provides for selective display of either a two-pack of product or display of individual units of products, it is to be understood that the invention can be carried out such that a selection is possible between any multiple number of units and a lower number of units.

In the illustrated embodiment, the device 10 is manufactured from a unitary piece of material which is perforated and folded as illustrated. Other methods of manufacture could be employed. Different geometric shapes and sizes could be employed for the portions and sections. While other materials could be employed, in the illustrated embodiment the device 10 (excluding the piece of tape) is constructed of cardboard. It can be appreciated that stronger materials, such as plastic, can be employed as long as it is possible to separate the first product supporting section 28 from the second product supporting section 32. Preferably, the first product supporting section 28 is readily manually separable from the second product supporting section 32 (i.e., without need for a tool).

In the illustrated embodiment, both units of product 12 are illustrated as being identical. However, it should be understood that the invention can be carried out such that the unit of product supported by or attached to the section 28 is different from the unit of product supported by or attached to the section 32. In such a case, the indicia on the section 28 would relate to the unit of product supported by or attached to the section 28, and the indicia on the section 32 would relate to the unit of product supported by or attached to the section 32.

Thus, a device has been disclosed which supports multiple units of products, and which provides for selective display of the products as either a multi-pack, or as individual units.

While a preferred embodiment of the invention has been described, by way of example, various modifications will become apparent to one of ordinary skill in the art. Thus, the scope of the invention is to be limited only by the spirit and scope of the following claims.

I claim:

1. A device for use in displaying product, said device comprising:

a first section including a surface for being affixed to a first unit of product; and a second section attached to said first section and including a surface for being affixed to a second unit of product, said second section being selectively removable from said first section;

said device being selectively alterable from a first mode wherein said device displays indicia relevant to multiple units of product to a second mode wherein said device displays indicia relevant to individual units of product and wherein, when said device is in said first mode, said device further includes a third section attached to said second section, said third section having theron said indicia relevant to multiple units of said products comprising a bar code, said device further including a perforation between said second section and said third section for selective removal of said third section from said second section, said indicia relevant to multiple units of said products further comprising a bar code on said second section, a bar code on said first section, a flap attached to said first and second sections and covering the bar code on said first section and the bar code on said second section, and a perforation between said flap and said first and second sections for selective removal of said flap from said first and second sections.

2. A device in accordance with claim 1 wherein, when said device is in said second mode, said third section is separated from said second section, and said flap is removed from said first and second sections so as to expose the bar code on said first section and the bar code on said second section.

3. A display assembly comprising: a first unit of product; a second unit of product; and a display card including a first portion comprising a first section supporting said first unit of product, and comprising a second section supporting said second unit of product; a perforation between said first section and said second section, said second section being selectively removable from said first section by tearing along said perforation; a barcode on said first section; a barcode on said second section; a second portion connected to said first portion and having a width less than half of a width of said first portion, said width of said first and second portions being in a direction parallel to said perforation, said second portion covering said barcode on said first section and said barcode on said second section; and a perforation between said first portion and said second portion, said second portion being separable from said first portion by tearing along said perforation between said first portion and said second portion.

4. A display assembly in accordance with claim 3 wherein said display card attaches said first unit of product to said second unit of product, and wherein said first unit of product is not attached to said second unit of product except by said display card.

5. A display assembly in accordance with claim 3 wherein said first unit of product is identical to said second unit of product.

6. A display assembly in accordance with claim 3 wherein said display card further includes a third section attached to said second section, said third section having thereon a bar code including information relating to both said first and second units of product, said display card further including a perforation between said second section and said third section for selective removal of said third section from said second section.

7. A display assembly in accordance with claim 3 and further including a vertical axis of said display assembly; means located approximately along said vertical axis of said display assembly, for selective supportive engagement by a display rack.

* * * * *